US006990761B1

(12) United States Patent
Cox

(10) Patent No.: US 6,990,761 B1
(45) Date of Patent: Jan. 31, 2006

(54) IDENTIFICATION TAG AND METHOD OF MAKING THE SAME FOR WIRE ROPE SLINGS

(75) Inventor: Jody Cox, Yukon, OK (US)

(73) Assignee: F&M Mafco, Inc., Harrison, OH (US)

( * ) Notice: Subject to any disclaimer, the term of this patent is extended or adjusted under 35 U.S.C. 154(b) by 0 days.

(21) Appl. No.: 10/633,151

(22) Filed: Aug. 1, 2003

Related U.S. Application Data

(60) Provisional application No. 60/400,808, filed on Aug. 2, 2002.

(51) Int. Cl.
*G09F 3/00* (2006.01)

(52) U.S. Cl. ..... 40/316; 24/129 W

(58) Field of Classification Search ..... 40/316, 40/638, 660, 299.01; 403/212; 24/129 W; 16/108; 174/112; 283/107, 108, 109, 110
See application file for complete search history.

(56) References Cited

U.S. PATENT DOCUMENTS

| | | | | | |
|---|---|---|---|---|---|
| 2,914,166 | A * | 11/1959 | Bihler | 206/526 |
| 4,126,936 | A * | 11/1978 | Koller | 29/863 |
| 4,139,956 | A * | 2/1979 | Sharrow | 40/316 |
| 4,159,586 | A * | 7/1979 | Blum | 40/638 |
| 4,242,777 | A * | 1/1981 | Bourard et al. | 24/115 A |
| 4,246,709 | A * | 1/1981 | Selleslags | 40/638 |
| 4,656,767 | A * | 4/1987 | Tarrant | 40/316 |
| 5,157,853 | A * | 10/1992 | Piana et al. | 40/316 |
| 5,366,575 | A * | 11/1994 | Staff et al. | 156/185 |
| 6,170,145 | B1 * | 1/2001 | Lucas | 29/517 |
| 6,651,362 | B2 * | 11/2003 | Caveney | 40/316 |

* cited by examiner

*Primary Examiner*—Andrew D. Wright
(74) *Attorney, Agent, or Firm*—Head, Johnson & Kachigian

(57) ABSTRACT

After a wire rope sling is fabricated and the sleeve has been painted and dried, an adhesive type of tag containing all of the information required by ASME B30.9c is applied directly to the sleeve's surface. The sleeve and the tag will then be encased using a transparent casing, coating, or sealant. This will protect the tag from abrasion, the environment, and will ensure a permanent and legible tag.

2 Claims, 2 Drawing Sheets

IDENTIFICATION TAG AND METHOD OF MAKING THE SAME FOR WIRE ROPE SLINGS

CROSS-REFERENCE TO PENDING APPLICATIONS

This application is based on U.S. Provisional Patent Application No. 60/400,808 filed Aug. 2, 2002 and entitled "Identification Tag and Method of Making The Same For Wire Rope Slings".

BACKGROUND OF THE INVENTION

1. Field of the Invention

In general, the present invention relates to identification markings for wire rope slings. More particularly, the present invention relates to a method and apparatus for providing new and improved tagging of specifications required by ASME standards to wire rope slings.

2. Description of the Prior Art

Wire rope or wire rope slings generally refer to ropes made from metal for lifting, rigging and load securing used in heavy industry. One type of wire rope consists of a group of strands laid helically around a core.

Due to the inherent risks associated with the use of such in heavy industrial application, it is critical the proper type of wire rope or sling is used for the load and application. Needless to say, loss of life and massive damage may result in the improper use of a rope sling which may fail due to improper use of a rope sling that is not designed for the job required.

Previously, American Society of Mechanical Engineers (ASME) B30.9c standards did not require all wire rope slings to be permanently marked or identified with information on the specifications of the slings. It is now required that all wire rope slings be tagged with trade mark of the manufacturer, diameter or size, rated load for the type hitch or hitches, and the angle upon which the rated load is based.

Thus, under current standards, a wire rope sling may not be used if the proper identification tag is missing due to the inherent risks of using the wrong type of wire rope slings in heavy industrial applications. Even though a wire rope sling may be new or in perfect condition, it may not be used without the proper information a tag provides. Specifically, Section 9-2.5.2 requires that sling identification be initially done by the manufacturer. Section 9-2.5.3 requires sling identification be maintained by the user so as to be legible during the life of the sling. A wire rope sling with a missing tag is worthless.

In the prior art, sling tags were attached to the wire rope slings using either bailing wire or small diameter galvanized cable. The wire or cable was fed through a hole drilled in a steel or aluminum sling tag and then inserted into the sleeve and swagged. The prior art has many disadvantages such as, but not limited to, tags which were left freely suspended outside of the sling. This allowed the tag to catch on objects and be ripped away from the sling early in the sling's service life, hence making the wire rope sling unusable.

Furthermore, the prior art tags often use a metal tag, such as aluminum, as described above that may be easily bent. It is found in the prior art that even though the tag may have not been ripped completely from the sling, it may still be hazardous to use a tag wherein the information needed may have been rendered unreadable. Still further, the prior art tags are often damaged by abrasion which may also leave the information on the tag unreadable.

There is an ongoing need for having the proper equipment for the job. Time lost and the cost associated with time lost waiting for the replacement of a wire rope sling which may have been perfectly usable but for the missing or damaged tag can be staggering as well as frustrating. Consequently, the prior art tags create a significant and possibly even deadly situation where an operator mistakenly uses a sling missing a tag or having a damaged tag believing they have the appropriate sling for the job required.

The ability to ascertain the correct use of a wire rope sling for the job at hand and eliminate the waste associated with missing tags on slings is imperative. The current invention provides an inexpensive, time saving, and efficient tag for wire rope slings and method for making the same where the prior art fails.

SUMMARY OF THE INVENTION

In view of the foregoing disadvantages inherent in the known types of tagging wire rope slings now present in the prior art, the present invention provides a new and improved identification tag and method of making the same for wire rope slings wherein the same can be utilized reliably in those situations where dependability, wear, and simplicity is desired. As such, the general purpose of the present invention, which will be described subsequently in greater detail, is to provide a new and improved identification tag and method of making the same for wire rope slings which has all the advantages of the prior art devices and none of the disadvantages.

After a wire rope sling is fabricated and the sleeve has been painted and dried, an adhesive type of tag containing all of the information required by ASME B30.9c is applied directly to the sleeve's surface. The sleeve and the tag will then be encased using a transparent casing, coating, or sealant. This will protect the tag from abrasion, the environment, and will ensure a permanent and legible tag.

Furthermore, it is contemplated that the identification information required may be applied to the sleeve of the wire rope sling surface such as but not limited to printing, embossing, engraving, or the like after the wire rope sling has been fabricated. Still furthermore, it is contemplated that the sleeve may have the identification material affixed thereto by such means as printing, engraving, embossing or the like before the sleeve is attached to the wire rope. It is also contemplated that the method of attaching or swagging the sleeve to the wire rope may include a die for printing, embossing or engraving the material to the sleeve as it is swagged or crimped to wire rope.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved identification tag and method of making the same for wire rope slings which may be easily and efficiently manufactured and marketed.

It is a further object of the present invention to provide a new and improved identification tag and method of making the same for wire rope slings which is of a durable and reliable construction.

An even further object of the present invention is to provide a new and improved identification tag and method of making the same for wire rope slings which is susceptible to a low cost of manufacture with regard to both materials and labor, and which accordingly is then susceptible to low prices of sale to the consuming industry, thereby making such economically available to those in consuming industry.

Still another object of the present invention is to provide a new and improved identification tag and method of making the same for wire rope slings which provides all of the advantages of the prior art, while simultaneously overcoming some of the disadvantages normally associated therewith.

Another object of the present invention is to provide a new and improved identification tag and method of making the same for wire rope slings which may be referenced quickly and accurately to provide information regarding use of the wire rope sling immediately in the field.

Yet another object of the present invention is to provide a new and improved identification tag and method of making the same for wire rope slings which will not tear or be ripped off during normal operations involving wire rope slings in heavy industrial applications.

An even further object of the present invention is to provide an identification tag and method of making the same for wire rope slings with simplified operation, less susceptible to damage than the prior art and therefore provide greater safety in the field of use of wire rope slings.

These, together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed pictorial illustrations, graphs, drawings, and appendices that may be included wherein.

DETAILED DESCRIPTION OF THE PREFERRED EMBODIMENTS

Figure 1:
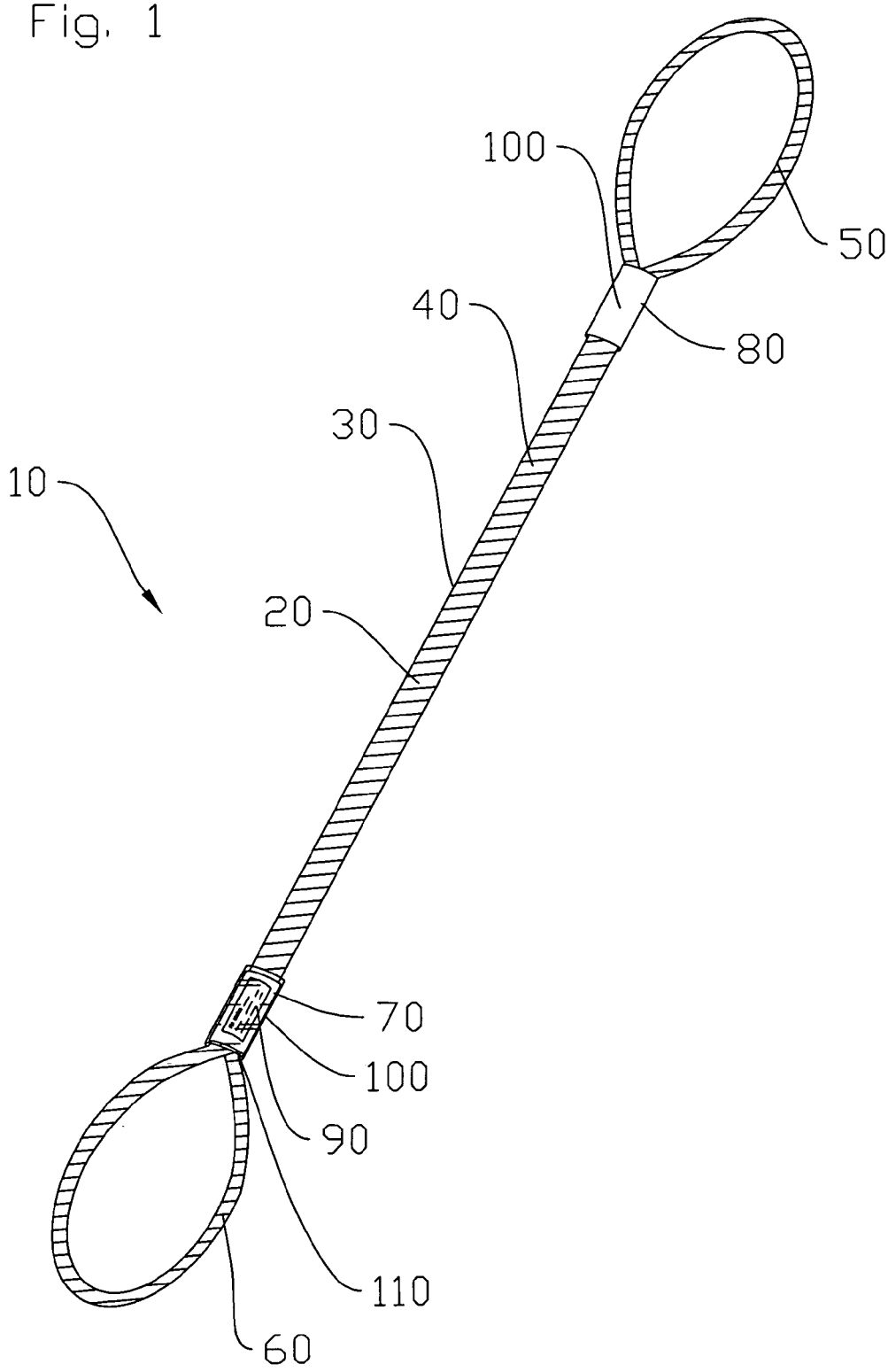
FIG. 1 is a perspective pictorial illustration of a preferred embodiment of the invention generally attached to a wire rope sling.
Figure 2:
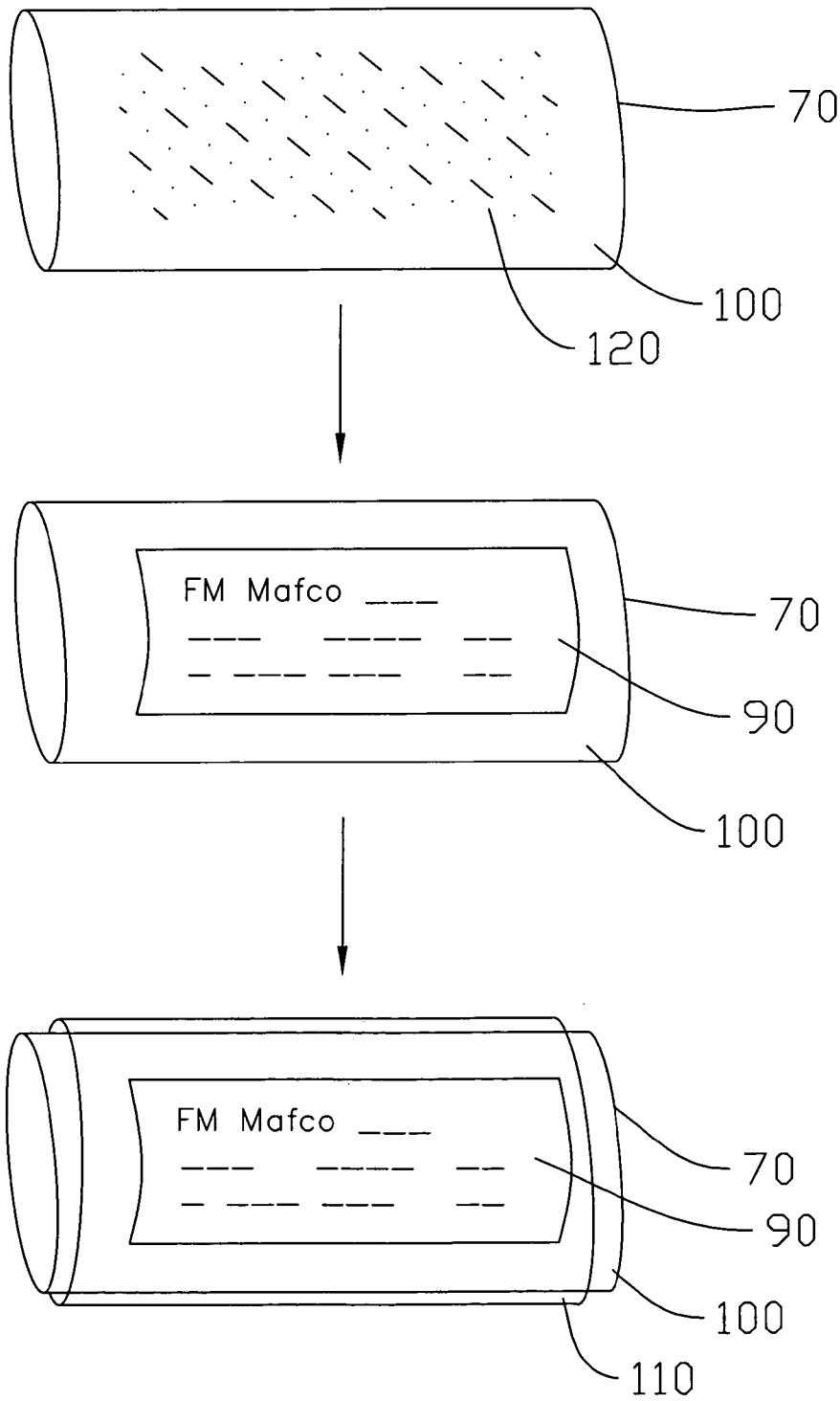
FIG. 2 is a sequential, partial pictorial illustration of the preferred embodiment generally depicting a method for producing a preferred embodiment as generally depicted in FIG. 1.

Referring to the illustrations, drawings, and pictures, and to FIGS. 1 and 2 in particular, reference character 10 generally designates a new and improved identification tag and method of making the same for a wire rope sling 20 constructed in accordance with a preferred embodiment of the present invention. Typically in the art, wire rope sling 20 generally comprises a wire rope 30 that has been braided or twisted using multiple steel cables 40 or strands.

Wire rope sling 20 is generally fashioned such that a first loop 50 and a second loop 60 are created by bending or flemishing the wire rope 30. In certain applications, the steel cables 40 may be braided to form the loops or eyes. After the wire rope 30 is bent or flemished to create first loop 50 and second loop 60 respectively, a first sleeve 70 and a second sleeve 80, respectively, are driven up, swagged or generally attached. The sleeves may be attached by pressure from a die. It is also known in the art that once first sleeve 70 and second sleeve 80 are swagged, they are gauged to ensure proper after-swage dimensions, spray painted in order to check for any cracks that may have occurred during swagging, and then left for the paint to dry.

The invention 10 generally includes an identification tag 90 generally attached to the first sleeve 70 or second sleeve 80 respectively or both. In a preferred construction, the tag 90 is adhesively affixed to first sleeve 70 surface 100. The tag 90 generally includes identification material such as, but not limited to, the trademark of the manufacturer, diameter or size, rated load information for the type hitch or hitches, and the angle upon which it is based. The tag 90 may be made of paper, plastic, metal or other suitable material which may receive the aforementioned identification material generally required by ASME B30.9c.

In a preferred construction, first sleeve 70 and tag 90 affixed thereto are then encapsulated in a transparent material 110 that protects the tag 90 from abrasion, the environment, and will also ensure the material inscribed therein will be legible after normal use. The transparent material 110 may be, but is not limited to, plastic that has been poured over first sleeve 70 or of such a nature that the plastic may be snapped over first sleeve 70. It is further contemplated that transparent material 110 may be a casing, coating or sealant. In one preferred embodiment, the transparent material 110 may be injection molded around the sleeve.

In a preferred embodiment, adhesive 120 may be used to attach the tag 90 to surface 100 of first sleeve 70. The adhesive 120 may be, but is not limited to, conventional bonding or glueing material. It is further contemplated that adhesive 120 need not be used wherein tag 90 is held to surface 100 by the transparent material 110. It is still further contemplated that tag 90 may already include an adhesive material 120 generally on the back side of tag 90 for direct application to surface 100.

METHOD OF MANUFACTURE

The present invention 10 may be produced as generally outlined above. A preferred construction may also include the following steps but should not be considered limited to the following steps:

The wire rope sling 20 is fabricated with a first sleeve 70 and a second sleeve 80 attached or swagged respectively to wire rope 30 such that a first loop 50 and a second loop 60 are respectively generally created. In one preferred method, a die is brought over the sleeve and then pressure applied to affix the sleeve in a known cold press method.

Following fabrication of the sleeve or sleeves, an adhesive 120 is generally positioned on a surface 100 of the first sleeve.

The tag 90 is then generally positioned on surface 100 such that adhesive 120 attaches tag 90 to first sleeve 70 surface 100 and wherein the tag generally includes the trademark of manufacturer, diameter or size, rated load for the type hitch or hitches, and the angle upon which it is based.

Thereafter, the tag 90 is generally covered, encased or sealed to surface 100 of first sleeve 70 by transparent material 110.

Furthermore, it is understood that the above mentioned method and steps may also include adding tag 90 to second sleeve 80 as generally described by the above steps so that both first sleeve 70 and second sleeve 80 include tag 90.

Still further, it is understood that tag 90 may further include an adhesive 120 to the back portion of tag 90 thus eliminating the step of positioning adhesive material 120 to surface 100 before generally positioning tag 90.

The invention 10 should not be considered limited by its title. It is still further contemplated that invention 10 is not limited to wire rope slings but may be used in other applications where it is required to have identifying material affixed for use in heavy industrial situations where it is desired.

Changes may be made in the combinations, operations, and arrangements of the various parts and elements described herein without departing from the spirit and scope of the invention.

What is claimed is:

1. A method of making an identification tag for a wire rope termination which method comprises:

swaging a wire rope termination sleeve to a wire rope;

applying adhesive to a surface of said sleeve;

thereafter positioning a tag having identifying information over said sleeve so that said tag is adhesively secured to said sleeve; and thereafter encasing said tag by injection molding of a transparent material over said tag.

2. A method of making an identification tag as set forth in claim 1 wherein said step of encasing said tag with a transparent material is accomplished by molding a clear plastic cover over said tag.

* * * * *